US012584231B2

(12) United States Patent
Lee et al.

(10) Patent No.: US 12,584,231 B2
(45) **Date of Patent: *Mar. 24, 2026**

(54) SILVER NANOCLUSTERS DOPED WITH RHODIUM HYDRIDE, MANUFACTURING METHOD THEREOF, AND ELECTROCHEMICAL CATALYST FOR HYDROGEN GAS GENERATION

(71) Applicant: Industry-Academic Cooperation Foundation, Yonsei University, Seoul (KR)

(72) Inventors: Dongil Lee, Goyang-si (KR); Hanseok Yi, Seoul (KR); Sang Myeong Han, Seoul (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 699 days.

This patent is subject to a terminal disclaimer.

(21) Appl. No.: 17/959,369

(22) Filed: Oct. 4, 2022

(65) Prior Publication Data

US 2023/0151502 A1 May 18, 2023

(30) Foreign Application Priority Data

Aug. 5, 2021 (KR) ..... 10-2021-0103133
Nov. 1, 2021 (KR) ..... 10-2021-0147918

(51) Int. Cl.
*C25B 11/091* (2021.01)
*C25B 1/04* (2021.01)
*C25B 9/17* (2021.01)

(52) U.S. Cl.
CPC ..... *C25B 11/091* (2021.01); *C25B 1/04* (2013.01); *C25B 9/17* (2021.01)

(58) Field of Classification Search
CPC ..... C25B 11/091; C25B 1/04; C25B 9/17; C25B 11/075; C25B 11/065; C25B 11/052; B01J 23/66; B01J 35/33; B01J 23/464; B01J 31/226; B01J 37/16; Y02E 60/36
See application file for complete search history.

(56) References Cited

U.S. PATENT DOCUMENTS

2020/0024295 A1* 1/2020 Muresan ..... B01J 37/08
2022/0055020 A1* 2/2022 Chen ..... B01J 2235/30

FOREIGN PATENT DOCUMENTS

KR 1020120107303 A 10/2012
KR 101759433 B1 7/2017
KR 1020200125098 A 11/2020
KR 1020200125505 A 11/2020
KR 1020210092753 A 7/2021
WO WO-2018164642 A1 * 9/2018 ..... B22F 9/24
WO WO-2020218871 A1 * 10/2020 ..... B22F 1/16

OTHER PUBLICATIONS

Machine Translation of WO-2020218871-A1.*
"Superatom-in Superatom [RhH@Ag24(SPhMe2)18]2-Nanocluster" by Yi et al., Angew. Chem. Int. Ed. 60, pp. 22293-22300 (2021—available online Jul. 28, 2021).*
Supporting Information for "Superatom-in Superatom [RhH@Ag24(SPhMe2)18]2-Nanocluster" by Yi et al., Angew. Chem. Int. Ed. 60, pp. 22293-22300 (2021—available online Jul. 28, 2021).*
Yi et al. "Superatom-in-Superatom [RhH@Ag24(SPhMe2)18]2-Nanocluster", Angewandte Chemie International Edition, Jul. 2021, pp. 1-10, GDCh, A Journal of the German Chemical Society.
Chakrahari et al. "Synthesis of Bimetallic Copper-Rich Nanoclusters Encapsulating a Linear Palladium Dihydride Unit", Angewandte Chemie International Edition, 2019, pp. 4943-4947, vol. 58.

* cited by examiner

*Primary Examiner* — Bryan D. Ripa
(74) *Attorney, Agent, or Firm* — The Webb Law Firm

(57) ABSTRACT

The present invention relates to silver nanoclusters doped with rhodium hydride, a method of producing the same, and an electrochemical catalyst for hydrogen gas generation. The silver nanoclusters doped with rhodium hydride of the present invention have utility as an electrochemical catalyst, have a significantly low production cost compared to a platinum (Pt) catalyst according to the related art, and exhibit an effect of generating hydrogen gas equal to or greater than that of the Pt catalyst.

15 Claims, 5 Drawing Sheets

SILVER NANOCLUSTERS DOPED WITH RHODIUM HYDRIDE, MANUFACTURING METHOD THEREOF, AND ELECTROCHEMICAL CATALYST FOR HYDROGEN GAS GENERATION

CROSS-REFERENCE TO RELATED APPLICATIONS

This application claims priority to Korean Patent Application Nos. 10-2021-0103133 filed Aug. 5, 2021 and 10-2021-0147918 filed Nov. 1, 2021, the disclosures of which are hereby incorporated by reference in their entirety.

BACKGROUND OF THE INVENTION

Field of the Invention

The following disclosure relates to silver nanoclusters doped with rhodium hydride, a method of producing silver nanoclusters doped with rhodium hydride, an electrochemical catalyst containing the silver nanoclusters doped with rhodium hydride, and a hydrogen gas generator including the electrochemical catalyst.

Description of Related Art

Nanoclusters or superatoms, which are composed of a specific number of metal atoms and ligands, follow the macroatomic orbital theory that newly defines valence electrons of particles, which is a theory that considers the nanoclusters or superatoms as one superatom.

Nanoclusters have optical and electrochemical properties that are completely different from nanoparticles because they are more stable than one atom or nanoparticle, and have stronger molecular properties than metallic properties. In particular, as optical, electrical, and catalytic properties of the nanoclusters are sensitively changed according to the number of metal atoms, types of metal atoms, and ligands, studies on the nanoclusters have been actively conducted in a wide variety of fields.

On the other hand, as economic growth continues, fossil fuels are being rapidly depleted. Therefore, as a countermeasure against this problem, interest in developing new renewable energy and a high-performance catalyst for its effective use has rapidly increased. As such renewable energy, hydrogen gas is attracting attention as an infinitely renewable energy source that has no uneven distribution, has a high energy density (142 kJ/g), and is non-toxic. A catalyst is required for such a hydrogen gas evolution reaction, and it is required for the catalyst for generating hydrogen gas to be neither too strong nor too weak to bond with hydrogen. When a bonding force with hydrogen is too weak, it may be difficult to bond the catalyst for generating hydrogen gas and hydrogen, and when the bonding force with hydrogen is too strong, hydrogen gas may not be separated from the catalyst after the hydrogen gas evolution reaction is completed.

Until now, platinum (Pt) is known as the most suitable catalyst material for a hydrogen evolution reaction (HER).

However, since platinum (Pt) has a high price and limited reserves, it has low economic feasibility and becomes a constraint that inhibits commercialization. Therefore, the development of a high-performance catalyst for a hydrogen evolution reaction that may replace platinum has been demanded.

RELATED ART DOCUMENTS

Patent Documents (Patent Document 1) Korean Patent Laid-open Publication No. 10-2012-0107303 (Oct. 2, 2012)

(Patent Document 2) Korean Patent No. 10-1759433 (Jul. 12, 2017)

SUMMARY OF THE INVENTION

An embodiment of the present invention is directed to providing silver nanoclusters doped with rhodium hydride.

Another embodiment of the present invention is directed to providing a method of producing silver nanoclusters doped with rhodium hydride.

Still another embodiment of the present invention is directed to providing an electrochemical catalyst containing the silver nanoclusters doped with rhodium hydride.

Still another embodiment of the present invention is directed to providing a hydrogen gas generator including the electrochemical catalyst.

In one general aspect, there are provided silver nanoclusters doped with rhodium hydride, wherein the silver nanoclusters doped with rhodium hydride satisfy the following Chemical Formula 1:

$$[RhH_xAg_{24}(SR)_{18}]^{2-} \quad \text{[Chemical Formula 1]}$$

x is an integer of 1 to 3 according to an oxidation value of Rh; and

SR is an organic thiol-based ligand.

$RhH_x$ of Chemical Formula 1 may be RhH.

In Chemical Formula 1, the organic thiol-based ligand may be C1-C30 alkanethiol, C1-C10 alkyl-substituted C1-C30 alkanethiol, C6-C30 arylthiol, or C1-C10 alkyl-substituted C6-C30 arylthiol, and preferably, the organic thiol-based ligand may be C1-C4 alkyl-substituted C6-C12 arylthiol.

In another general aspect, a method of producing silver nanoclusters doped with rhodium hydride includes:

a step a) of preparing a reaction solution by reacting a silver precursor with an organic thiol-based ligand; and a step b) of producing nanoclusters satisfying the following Chemical Formula 1 by adding a rhodium hydride precursor and a reducing agent to the reaction solution:

$$[RhH_xAg_{24}(SR)_{18}]^{2-} \quad \text{[Chemical Formula 1]}$$

x is an integer of 1 to 3 according to an oxidation value of Rh; and

SR is an organic thiol-based ligand.

The method may further include, after the step b), a step of performing precipitation separation with an aromatic solvent.

A molar ratio of the silver precursor to the rhodium hydride precursor may be 1:0.02 to 0.2, and preferably, may be 1:0.05 to 0.15.

The silver precursor may be one or two or more selected from the group consisting of $AgNO_3$, $AgBF_4$, $AgCF_3SO_3$, $AgClO_4$, $AgO_2CCH_3$, and $AgPF_6$, and the rhodium hydride precursor may be a halide hydrate of Rh.

The reducing agent may be one or two or more selected from triethylamine, oleylamine, carbon monoxide, and sodium borohydride.

In still another general aspect, an electrochemical catalyst contains the silver nanoclusters doped with rhodium hydride. The electrochemical catalyst may be an electrochemical catalyst for hydrogen gas generation. In still another general aspect, a hydrogen gas generator includes the electrochemical catalyst.

The hydrogen gas generator may further include:

a power supply;

a working electrode and a counter electrode that are connected to the power supply; and an aqueous electrolyte impregnated with the electrodes, wherein the working electrode is coated with the electrochemical catalyst.

Other features and aspects will be apparent from the following detailed description, the drawings, and the claims.

DESCRIPTION OF THE INVENTION

Figure 1:
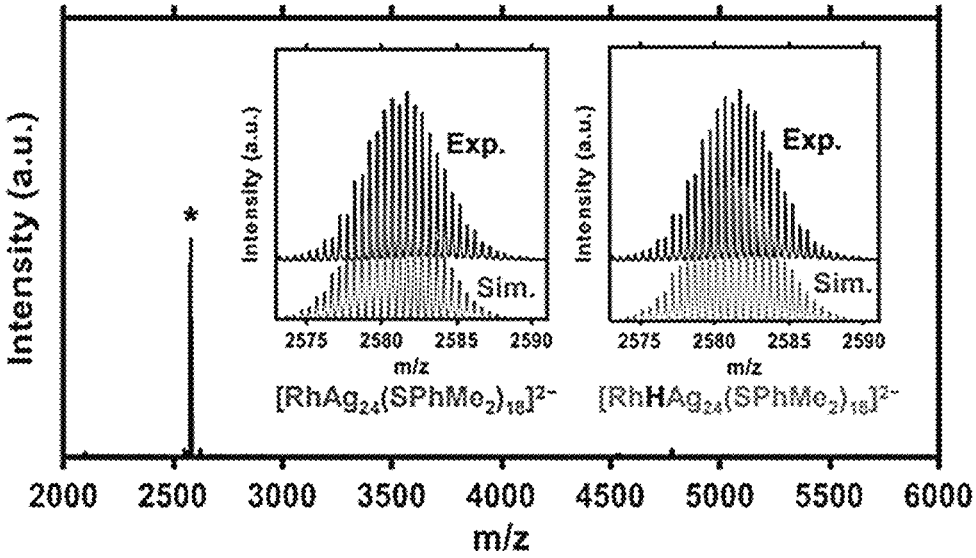
FIG. 1 is a view illustrating a result of electrospray ionization mass spectrometry (ESI-MS) of Example 1.

Hereinafter, silver nanoclusters doped with rhodium hydride, a method of producing silver nanoclusters doped with rhodium hydride, an electrochemical catalyst containing the silver nanoclusters doped with rhodium hydride, and a hydrogen gas generator including the electrochemical catalyst according to the present invention will be described in detail.

However, unless otherwise defined, all the technical terms and scientific terms used herein have the same meanings as commonly understood by those skilled in the art to which the present invention pertains, and descriptions for the known function and configuration unnecessarily obscuring the gist of the present invention will be omitted in the following descriptions.

Unless the context clearly indicates otherwise, singular forms used in the present invention may be intended to include plural forms.

In addition, a numerical range used in the present invention includes upper and lower limits and all values within these limits, increments logically derived from a form and span of a defined range, all double limited values, and all possible combinations of the upper and lower limits in the numerical range defined in different forms. Unless otherwise specifically defined in the specification of the present invention, values out of the numerical ranges that may occur due to experimental errors or rounded values also fall within the defined numerical ranges.

The expression "comprise(s)" described in the present invention is intended to be an open-ended transitional phrase having an equivalent meaning to "include(s)," "contain(s)," "have (has)," and "are (is) characterized by," and does not exclude elements, materials, or steps, all of which are not further recited herein.

Until now, platinum (Pt) is known as the most suitable catalyst material for a hydrogen evolution reaction (HER). However, since platinum (Pt) has a high price and limited reserves, it has low economic feasibility and becomes a constraint that inhibits commercialization.

Accordingly, as a result of intensively conducting studies, the present inventors have found that when silver nanoclusters are doped with a hydride of rhodium metal, it is possible to provide a nanocluster catalyst that is inexpensive compared to platinum and has excellent hydrogen gas evolution reactivity, thereby completing the present invention.

Specifically, silver nanoclusters doped with rhodium hydride satisfying the following Chemical Formula 1 according to an exemplary embodiment of the present invention may have excellent activity for a hydrogen evolution reaction while being cheaper than platinum:

$$[RhH_xAg_{24}(SR)_{18}]^{2-} \quad \text{[Chemical Formula 1]}$$

x is an integer of 1 to 3 according to an oxidation value of Rh; and

SR is an organic thiol-based ligand.

In an exemplary embodiment, $RhH_x$ of Chemical Formula 1 may be RhH.

Specifically, according to an exemplary embodiment of the present invention, in Chemical Formula 1, the organic thiol-based ligand may be one or two or more selected from the group consisting of C1-C30 alkanethiol, C6-C30 arylthiol, C3-C30 cycloalkanethiol, C5-C30 heteroarylthiol, C3-C30 heterocycloalkanethiol, and C6-C30 arylalkanethiol, and one or more hydrogens in a functional group in the organic thiol-based ligand may be unsubstituted or further substituted with a substituent. In this case, the substituent is C1-C10 alkyl, halogen, nitro, cyano, hydroxy, amino, C6-C20 aryl, C2-C7 alkenyl, C3-C20 cycloalkyl, C3-C20 heterocycloalkyl, or C4-C20 heteroaryl; however, the carbon number of the organic thiol-based ligand described above does not include the carbon number of the substituent.

More specifically, in Chemical Formula 1, the organic thiol-based ligand may be C1-C30 alkanethiol, C1-C10 alkyl-substituted C1-C30 alkanethiol, C6-C30 arylthiol, or C1-C10 alkyl-substituted C6-C30 arylthiol. As an example, the organic thiol-based ligand may be one or two or more selected from the group consisting of pentanethiol, hexanethiol, heptanethiol, and 2,4-dimethylbenzenethiol, but is not limited thereto.

Preferably, the organic thiol-based ligand may be C1-C4 alkyl-substituted C6-C12 arylthiol, and may be, for example, 2,4-dimethylbenzenethiol.

In the silver nanoclusters doped with rhodium hydride satisfying Chemical Formula 1 according to an exemplary embodiment of the present invention, $RhH_xAg_{12}$ present in the center may have an icosahedral structure and may have a form surrounded by six $Ag_2(SR)_3$'s.

A method of producing silver nanoclusters doped with rhodium hydride according to an exemplary embodiment of the present invention may include:

a step a) of preparing a reaction solution by reacting a silver precursor with an organic thiol-based ligand; and a step b) of producing nanoclusters satisfying the following Chemical Formula 1 by adding a rhodium hydride precursor and a reducing agent to the reaction solution:

$$[RhH_xAg_{24}(SR)_{18}]^{2-} \quad \text{[Chemical Formula 1]}$$

x is an integer of 1 to 3 according to an oxidation value of Rh; and

SR is an organic thiol-based ligand.

The nanoclusters for hydrogen gas generation satisfying Chemical Formula 1 are produced by such a method, such that it is possible to produce silver nanoclusters for hydrogen gas generation that are cheaper than platinum and have excellent activity for a hydrogen gas evolution reaction.

In an exemplary embodiment, the method may further include, after the step b), a step of performing precipitation separation with an aromatic solvent. Specifically, the aromatic solvent may be one or two or more selected from nitrobenzene, benzene, xylene, chlorobenzene, and toluene. More specifically, the aromatic solvent may be toluene, but is not limited thereto.

Unlike a method of producing silver nanoclusters or silver nanoclusters doped with dissimilar metals according to the related art, the method of producing silver nanoclusters doped with rhodium hydride according to an exemplary embodiment of the present invention is significantly advantageous when used industrially because nanoclusters may be synthesized relatively quickly without a long-term aging process.

In addition, unlike the method of producing silver nanoclusters doped with dissimilar metals according to the related art, in the method of producing silver nanoclusters doped with rhodium hydride according to an exemplary embodiment, a precipitation separation method using an aromatic solvent is adopted, such that perfect separation may be achieved without performing an aging process for collection, which is the existing method, thereby obtaining a high-purity product by an industrially easy method.

In an exemplary embodiment, a molar ratio of the silver precursor to the rhodium hydride precursor may be 1:0.02 to 0.2, and preferably, may be 1:0.05 to 0.15. The silver nanoclusters doped with rhodium hydride within the above range may be synthesized with a high yield.

In an exemplary embodiment, the silver precursor may be one or two or more selected from the group consisting of $AgNO_3$, $AgBF_4$, $AgCF_3SO_3$, $AgClO_4$, $AgO_2CCH_3$, and $AgPF_6$, and it is preferable to use $AgNO_3$ in order to significantly improve synthesis efficiency.

In an exemplary embodiment, the rhodium hydride precursor may be a halide hydrate of Rh, and may be, for example, $RhCl_3 \cdot xH_2O$, $RhBr_3 \cdot xH_2O$, or $RhI_3 \cdot xH_2O$, but is not limited thereto.

In addition, in an exemplary embodiment, any organic thiol-based ligand compound may be used as long as it is a compound that may be used as the organic thiol-based ligand represented by SR of Chemical Formula 1 as described above, and the organic thiol-based ligand compound may be RSH, which is a compound before hydrogen is dropped in comparison to SR. As a specific example, the organic thiol-based ligand compound may be pentanethiol, hexanethiol, heptanethiol, or 2,4-dimethylbenzenethiol, and more specifically, may be 2,4-dimethylbenzenethiol, but is not limited thereto.

In an exemplary embodiment of the present invention, a mixing ratio of the silver precursor to the organic thiol-based ligand compound may be a mixing ratio commonly used in the art, specifically, 1:1 to 10, more specifically, 1:2 to 5, and still more specifically, 1:2.5 to 3.5. In the above range, at the time of the production of the silver nanoclusters, the yield may be excellent, and impurities in the reaction may be reduced.

In an exemplary embodiment of the present invention, the reaction solution in the step a) may further include a solvent for dissolving the rhodium precursor and improving ease of the reaction, and any solvent may be used without particular limitation as long as it is commonly used in the art. As a specific example, the solvent may be a polar solvent, specifically, one or two or more selected from the group consisting of water, a C1-C5 alcohol, acetonitrile, dimethylsulfoxide (DMSO), dimethylformamide (DMF), acetone, tetrahydrofuran (THF), and 1,4-dioxane, and preferably, tetrahydrofuran (THF), but is not limited thereto.

In addition, in an exemplary embodiment, the method may further include, after the step a), a step of adding a ligand to form a complex with the silver nanoclusters doped with rhodium hydride. The ligand may be a ligand having a charge opposite to that of the silver nanocluster doped with rhodium hydride, and may be, for example, tetraphenylphosphonium bromide ($PPh_4^+$) or tetraoctylammonium bromide ($Oct_4N^+$), but is not limited thereto.

In an exemplary embodiment, any reducing agent may be used without particular limitation as long as it is a reducing agent commonly used in the art, and may be one or two or more selected from triethylamine, oleylamine, carbon monoxide, and sodium borohydride, and preferably sodium borohydride, but is not limited thereto.

In addition, after completion of the reaction in the step b), an additional purification step may be further performed to obtain high-purity silver nanoclusters, which may be performed by a common method.

In addition, the present invention provides an electrochemical catalyst containing the silver nanoclusters doped with rhodium hydride.

The electrochemical catalyst according to an exemplary embodiment may be an electrochemical catalyst for hydrogen gas generation used in the following reaction formula.

$$2H^+(aq) \rightarrow H_2(g) \quad \text{[Reaction Formula]}$$

The electrochemical catalyst for hydrogen gas generation according to an exemplary embodiment of the present invention may be economically and easily used in a hydrogen evolution reaction because it causes an electrochemical catalytic reaction from hydrogen ions ($2H^+$) to hydrogen gas ($H_2$) in an aqueous solution with high efficiency.

More preferably, the electrochemical catalyst containing the silver nanoclusters doped with rhodium hydride satisfying Chemical Formula 1 according to an exemplary embodiment of the present invention may secure a high-performance hydrogen gas evolution reactivity that is almost similar to that of a platinum catalyst in an alkaline solution. The present invention provides a hydrogen gas generator including the electrochemical catalyst.

The hydrogen gas generator according to an exemplary embodiment of the present invention may further include:

- a power supply;
- a working electrode and a counter electrode that are connected to the power supply; and
- an aqueous electrolyte impregnated with the electrodes, and
- the working electrode may be coated with the electrochemical catalyst according to an exemplary embodiment of the present invention.

In an exemplary embodiment, the working electrode coated with the electrochemical catalyst may include a conductive material and a polymer binder. When the conductive material is used, a weight ratio of the electrochemical catalyst to the conductive material may be 1:0.5 to 2 and preferably 1:0.8 to 1.2. When the weight ratio of the electrochemical catalyst to the conductive material satisfies the above range, the electrochemical catalyst for hydrogen gas generation may cover a surface of the conductive material with a single layer, such that the cost may be reduced by using a minimum amount of the catalyst and the maximum catalyst efficiency may be exhibited, which is preferable.

In an exemplary embodiment of the present invention, the conductive material may be a carbon body, and any conductive material may be used without particular limitation as long as it is commonly used in the art. As a specific example, the carbon body may be one or two or more selected from the group consisting of carbon black, super-p, activated carbon, hard carbon, and soft carbon, but is not limited thereto.

In addition, the polymer binder is used for firmly fixing the electrochemical catalyst for hydrogen gas generation and the conductive material, any polymer binder may be used without particular limitation as long as it is commonly used in the art, and specifically, the polymer binder may be nafion. The amount of the polymer binder added is not particularly limited as long as the electrochemical catalyst for hydrogen gas generation and the conductive material are firmly fixed. As a specific example, a weight ratio of the electrochemical catalyst to the polymer binder may be 1:5 to 30 and preferably 1:10 to 20, but is not limited thereto.

In addition, the present invention provides a method of producing hydrogen gas using the electrochemical catalyst containing the silver nanoclusters doped with rhodium hydride. In the method of producing hydrogen gas according to an exemplary embodiment, hydrogen gas may be produced using a hydrogen gas generator as described above, and hydrogen gas may be produced by applying a voltage to an electrode to which the electrochemical catalyst according to an exemplary embodiment is applied. As a specific example, the hydrogen gas generator is the same as described above, and thus a detailed description thereof will be omitted.

Hereinafter, the silver nanoclusters doped with rhodium hydride, the method of producing silver nanoclusters doped with rhodium hydride, the electrochemical catalyst containing the silver nanoclusters doped with rhodium hydride, and the hydrogen gas generator including the electrochemical catalyst according to the present invention will be described in more detail with reference to Examples. However, the following Examples are only reference examples for describing the present invention in detail, and the present invention is not limited thereto and may be implemented in various forms.

[Example 1] Preparation of $[RhHAg_{24}(SPhMe_2)_{18}]^{2-}$

At room temperature, 40.0 mg of $AgNO_3$ (0.23 mmol) (>99.9%, Alfa Aesar) was dissolved in 2 mL of water, 15 mL of tetrahydrofuran (THF) was added, and then the reaction solution was stirred vigorously for 2 minutes. 0.090 mL of 2,4-dimethylbenzenethiol (0.65 mmol) (>96%, Tokyo Chemical Industry) was added to the reaction solution.

To the reaction solution, 12 mg of tetraphosphonium bromide (0.028 mmol) (97%, Merck) dissolved in 1 mL of methanol was added, and 5 mg of $RhCl_3 \cdot xH_2O$ (0.024 mmol) (99.9%, Merck) was added. Then, 15 mg of $NaBH_4$ (0.4 mmol) dissolved in 0.5 mL of ice-cold water was added, the solution was stirred for 15 minutes, and then the solution was concentrated under reduced pressure and dried.

After the dried product was dissolved in 4 mL of methylene chloride, reaction by-products were precipitated with 8 mL of methanol, and 16 mL of methanol was added to the supernatant, and then centrifugation was performed. The obtained precipitate was silver nanoclusters doped with $Ag_{25}$ and RhH, and the silver nanoclusters were precipitated and separated using toluene, thereby obtaining $(PPh_4^+)_2[RhHAg_{24}(SPhMe_2)_{18}]^{2-}$.

[Comparative Example 1] Preparation of $[Ag_{25}(SPhMe_2)_{18}]^{1-}$ 40.0 mg of $AgNO_3$ (0.23 mmol) (>99.9%, Alfa Aesar) was dissolved in 2 mL of methanol, 15 mL of tetrahydrofuran (THF) was added, and then the reaction solution was stirred. 0.090 mL of 2,4-dimethylbenzenethiol (0.65 mmol) (>96%, Tokyo Chemical Industry) was added to the reaction solution, and the reaction solution was stirred under an ice bath for 20 minutes.

To the reaction solution, 6 mg of tetraphosphonium bromide (0.014 mmol) (97%, Merck) dissolved in 1 mL of methanol was added, and 15 mg of $NaBH_4$ (0.4 mmol) dissolved in 0.5 mL of ice-cold water was added. The reaction solution was stirred for 3 hours to perform a reduction reaction, the reaction solution was aged for 12 hours, centrifugation was performed to obtain a precipitate, and then the precipitate was washed with each of methylene chloride and methanol to remove impurities. 3 mg of the product was dissolved in 0.5 mL of methylene chloride, and then 5 mL of n-hexane was added for recrystallization, thereby obtaining $[Ag_{25}(SPhMe_2)_{18}]^{1-}$.

[Comparative Example 2] Preparation of $[PdAg_{24}(SPhMe_2)_{18}]^{2-}$ 40.0 mg of $AgNO_3$ (0.23 mmol) (>99.9%, Alfa Aesar) was dissolved in 2 mL of methanol, 15 mL of tetrahydrofuran (THF) was added, and then the reaction solution was stirred. 0.090 mL of 2,4-dimethylbenzenethiol (0.65 mmol) (>96%, Tokyo Chemical Industry) was added to the reaction solution, and the reaction solution was stirred under an ice bath for 20 minutes.

To the reaction solution, 12 mg of tetraphosphonium bromide (0.028 mmol) (97%, Merck) dissolved in 1 mL of methanol and 4 mg of $Na_2PdCl_4$ (0.01 mmol) (98%, Merck) were added, and 15 mg of $NaBH_4$ (0.4 mmol) dissolved in 0.5 mL of ice-cold water was added. The reaction solution was stirred for 6 hours to perform a reduction reaction, the reaction solution was aged for 12 hours, centrifugation was performed to obtain a precipitate, and then the precipitate was washed with each of methylene chloride and methanol to remove impurities. 3 mg of the product was dissolved in 0.5 mL of methylene chloride, and then 5 mL of n-hexane was added for recrystallization, thereby obtaining $[PdAg_{24}(SPhMe_2)_{18}]^{2-}$.

[Comparative Example 3] Preparation of $[PtAg_{24}(SP\ Me_2)_{18}]^{2-}$ $[PtAg_{24}(SPhMe_2)_{18}]^{2-}$ was obtained in the same manner as that of Comparative Example 2, except that 4 mg of $Na_2PtCl_4 \cdot xH_2O$ (0.01 mmol) (Merck) was used instead of 4 mg of $Na_2PdCl_4$ (0.01 mmol) (98%, Merck).

[Experimental Example 1] Confirmation of Synthesis

As illustrated in FIG. 1, through electrospray ionization mass spectrometry (ESI-MS), it was confirmed that the silver nanoclusters of Example 1 were synthesized as a single material.

Figure 2:
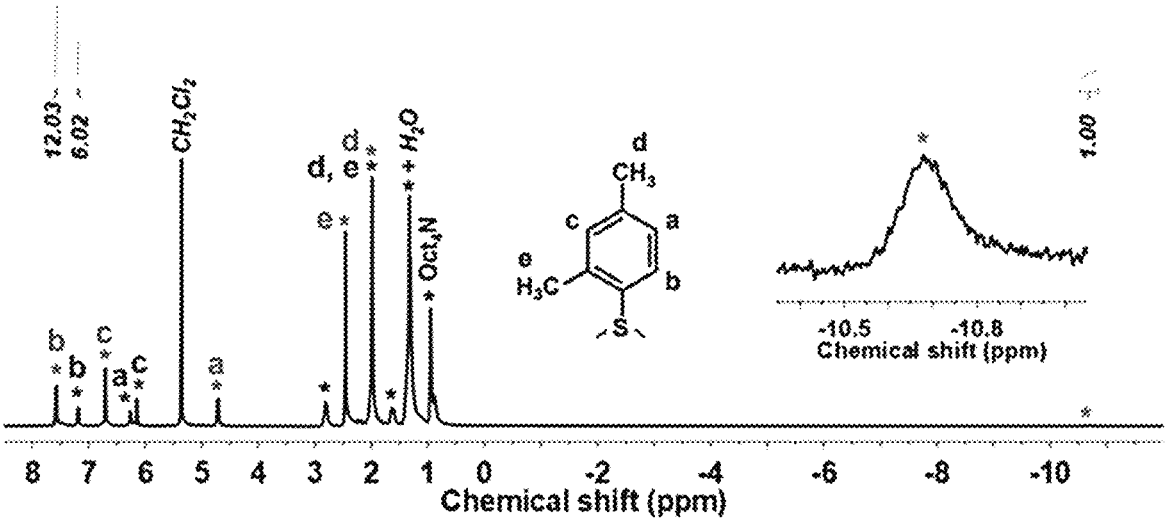
FIG. 2 is a view illustrating a result of $^1$H-NMR spectrum analysis of Example 1.

As illustrated in FIG. 2, $^1$H-NMR spectrum analysis of the silver nanoclusters of Example 1 in which a complex was formed with $Oct_4N^+$ instead of PPhe was performed in order to more clearly analyze the $^1$H-NMR spectrum. It was confirmed through FIG. 2 that the $Ag_{24}(SPhMe_2)_{18}$ skeleton was doped with the hydrogen atoms of the silver nanoclusters of Example 1 together with rhodium.

[Experimental Example 2] Analysis of Electrochemical Properties

Figure 3:
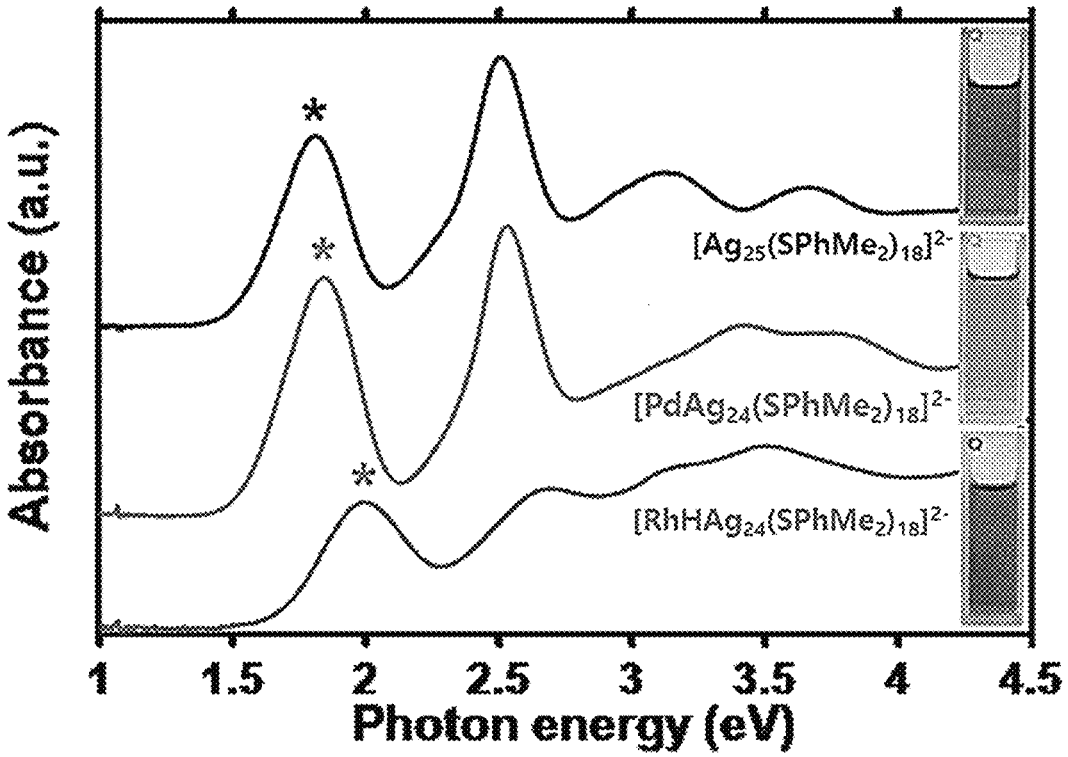
FIG. 3 is a view illustrating results of ultraviolet-visible light (UV-Vis) spectrum analysis of Comparative Examples 1 and 2 and Example 1.

As illustrated in FIG. 3, through the ultraviolet-visible light (UV-Vis) spectrum analysis of Example 1 and Comparative Examples 1 and 2, it was confirmed that the electronic structure was sensitively changed according to the types of doped metal and metal hydride.

Figure 4:
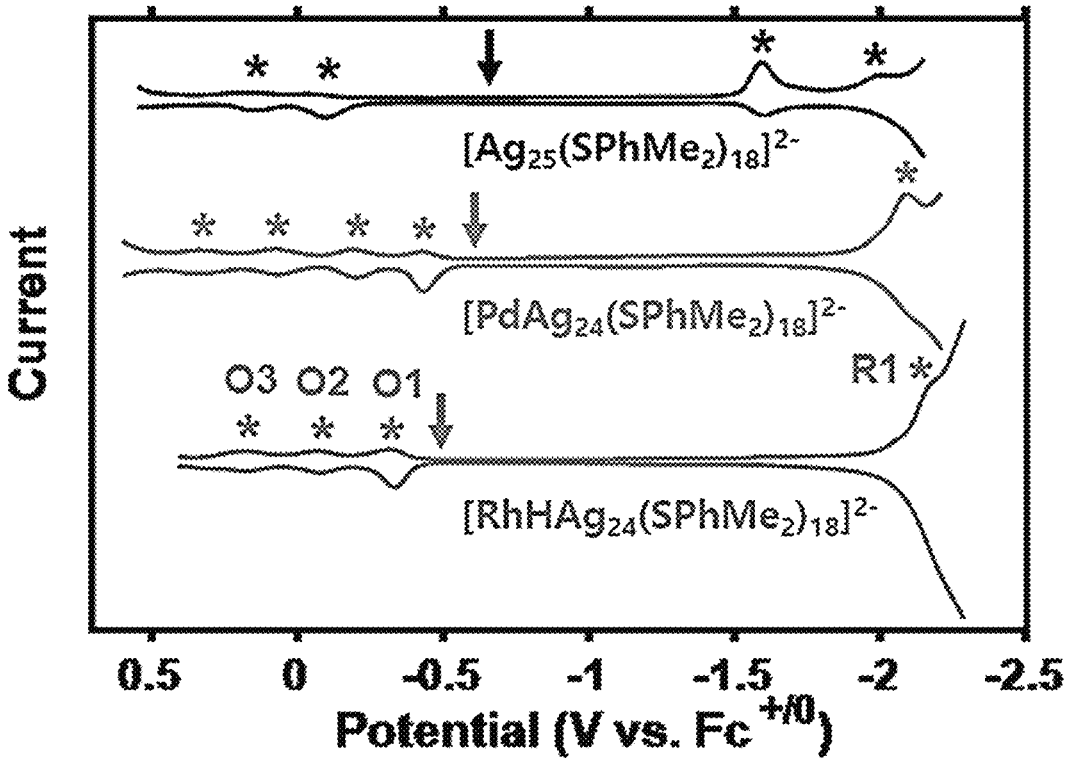
FIG. 4 is a view illustrating results of square wave voltammogram (SWV) analysis of Comparative Examples 1 and 2 and Example 1.

In addition, as illustrated in FIG. 4, through the square wave voltammogram (SWV) analysis of Example 1 and Comparative Examples 1 and 2, it was confirmed that a HOMO-LUMO gap was consistent with the predicted value obtained by discrete Fourier transform (DFT) calculation.

Figure 5:
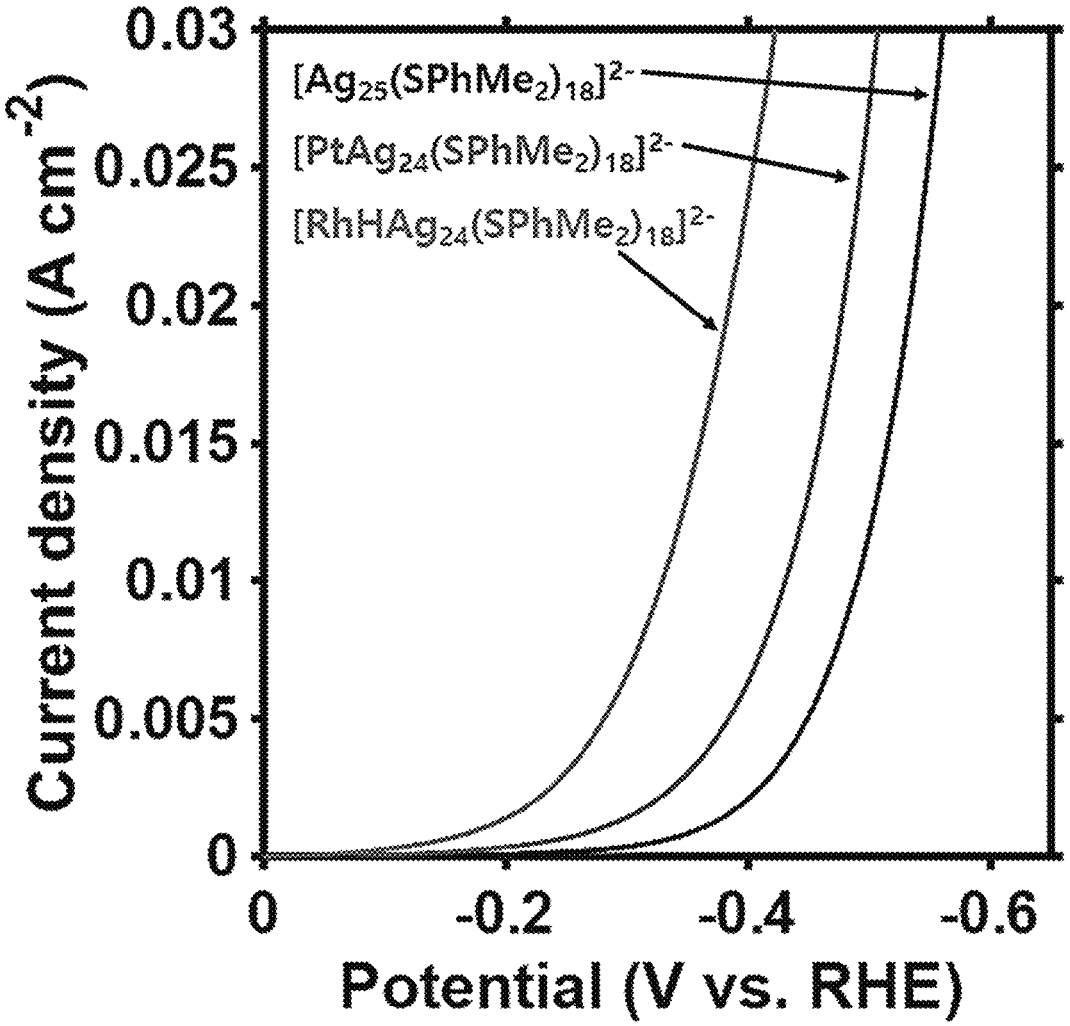
FIG. 5 is a graph obtained by measuring hydrogen evolution reaction (HER) performance of Example 1 and Comparative Examples 1 and 3.

FIG. 5 is a graph obtained by measuring hydrogen evolution reaction (HER) performance of Example 1 and Comparative Examples 1 and 3. As illustrated in FIG. 5, it was confirmed that the onset potential of Example 1 was closer to the theoretical value compared to the values of Comparative Examples 1 and 3. In the silver nanoclusters doped with rhodium hydride according to an exemplary embodiment of the present invention, it was found, based on these results, that the effect of generating hydrogen gas was excellent.

Figure 6:
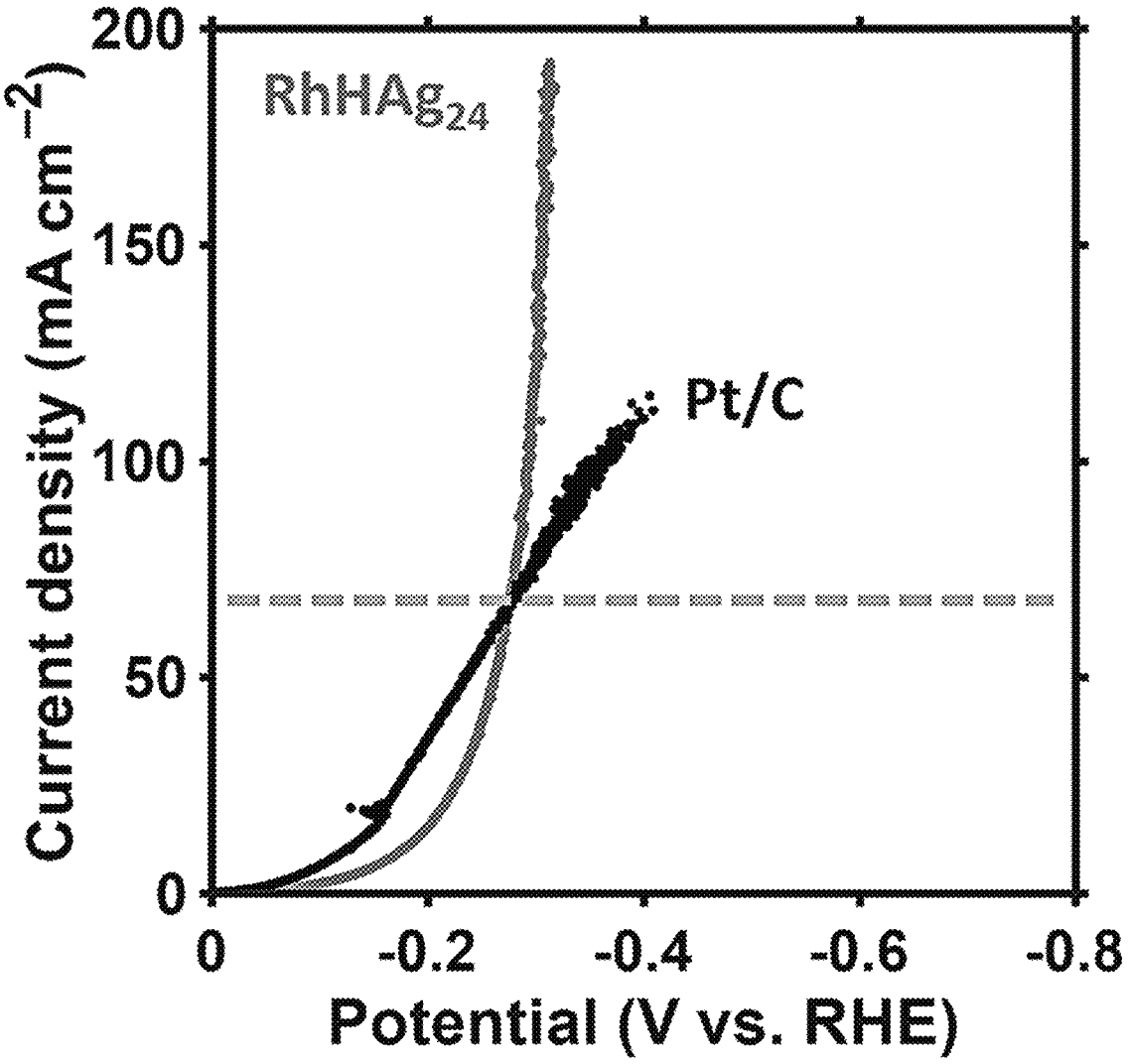
FIG. 6 is graph obtained by measuring linear sweep voltammetry of each of the electrochemical catalyst of Example 1 and the electrochemical catalyst adopting Pt/C.

FIG. 6 illustrates a graph obtained by measuring linear sweep voltammetry of each of the electrochemical catalyst of Example 1 and the electrochemical catalyst adopting Pt/C, which has been widely used as a catalyst in the related art. As illustrated in FIG. 6, it was confirmed that in Example 1 of the present invention, the value at the same voltage reference current was higher than that of Pt/C in a high current density region in which a current density was 70 $mA/cm^2$ or higher, and thus the electrochemical performance was excellent.

Therefore, the electrochemical catalyst for hydrogen gas generation adopting the silver nanoclusters doped with rhodium hydride according to an exemplary embodiment of the present invention has excellent economical feasibility due to its low price and excellent electrochemical performance in comparison to the platinum catalyst according to the related art.

As set forth above, the electrochemical catalyst adopting the silver nanoclusters doped with rhodium hydride according to an exemplary embodiment of the present invention has a significantly low production cost compared to the catalyst doped with platinum (Pt) according to the related art, and may implement an effect of generating hydrogen gas equal to or greater than that of the Pt catalyst.

Further, the method of producing silver nanoclusters doped with rhodium hydride according to an exemplary embodiment of the present invention is advantageous for mass production under simple and mild conditions.

The hydrogen gas generator including the electrochemical catalyst according to an exemplary embodiment of the present invention is used, such that the hydrogen gas evolution reaction activity may be significantly improved.

Hereinabove, although the present invention has been described by specific matters and limited exemplary embodiments, they have been provided only for assisting in the entire understanding of the present invention. Therefore, the present invention is not limited to the above exemplary embodiments. Various modifications and changes may be made by those skilled in the art to which the present invention pertains from this description.

Therefore, the spirit of the present invention should not be limited to the described exemplary embodiments, but the claims and all modifications equal or equivalent to the claims are intended to fall within the spirit of the present invention.

What is claimed is:

1. Silver nanoclusters doped with rhodium hydride, wherein the silver nanoclusters doped with rhodium hydride satisfy the following Chemical Formula 1:

$$[RhH_xAg_{24}(SR)_{18}]^{2-} \quad \text{[Chemical Formula 1]}$$

where x is an integer of 1 to 3 according to an oxidation value of Rh; and

SR is an organic thiol-based ligand.

2. The silver nanoclusters doped with rhodium hydride of claim 1, wherein $RhH_x$ of Chemical Formula 1 is RhH.

3. The silver nanoclusters doped with rhodium hydride of claim 1, wherein in Chemical Formula 1, the organic thiol-based ligand is C1-C30 alkanethiol, C1-C10 alkyl-substituted C1-C30 alkanethiol, C6-C30 arylthiol, or C1-C10 alkyl-substituted C6-C30 arylthiol.

4. The silver nanoclusters doped with rhodium hydride of claim 3, wherein the organic thiol-based ligand is C1-C4 alkyl-substituted C6-C12 arylthiol.

5. A method of producing silver nanoclusters doped with rhodium hydride, the method comprising the steps of:

step a) preparing a reaction solution by reacting a silver precursor with an organic thiol-based ligand; and step b) producing nanoclusters satisfying the following Chemical Formula 1 by adding a rhodium hydride precursor and a reducing agent to the reaction solution:

$$[RhH_xAg_{24}(SR)_{18}]^{2-} \quad \text{[Chemical Formula 1]}$$

where x is an integer of 1 to 3 according to an oxidation value of Rh; and

SR is an organic thiol-based ligand.

6. The method of claim 5, further comprising, after step b), a step of performing precipitation separation with an aromatic solvent.

7. The method of claim 5, wherein a molar ratio of the silver precursor to the rhodium hydride precursor is 1:0.02 to 0.2.

8. The method of claim 7, wherein the molar ratio of the silver precursor to the rhodium hydride precursor is 1:0.05 to 0.15.

9. The method of claim 5, wherein the silver precursor is one or two or more selected from the group consisting of $AgNO_3$, $AgBF_4$, $AgCF_3SO_3$, $AgClO_4$, $AgO_2CCH_3$, and $AgPF_6$.

10. The method of claim 5, wherein the rhodium hydride precursor is a halide hydrate of Rh.

11. The method of claim 5, wherein the reducing agent is one or two or more selected from triethylamine, oleylamine, carbon monoxide, and sodium borohydride.

12. An electrochemical catalyst comprising the silver nanoclusters doped with rhodium hydride of claim 1.

13. The electrochemical catalyst of claim 12, wherein the electrochemical catalyst is an electrochemical catalyst for hydrogen gas generation.

14. A hydrogen gas generator comprising the electrochemical catalyst of claim 12.

15. The hydrogen gas generator of claim 14, further comprising:

a power supply;

a working electrode and a counter electrode that are connected to the power supply; and an aqueous electrolyte impregnated with the electrodes, wherein the working electrode is coated with the electrochemical catalyst.

* * * * *